US011091869B2

(12) United States Patent
Kim et al.

(10) Patent No.: US 11,091,869 B2
(45) Date of Patent: Aug. 17, 2021

(54) BALANCER AND WASHING MACHINE

(71) Applicant: LG Electronics Inc., Seoul (KR)

(72) Inventors: Bongjae Kim, Seoul (KR); Jaehyun Kim, Seoul (KR); Jinho Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 118 days.

(21) Appl. No.: 16/656,101

(22) Filed: Oct. 17, 2019

(65) Prior Publication Data

US 2020/0123691 A1 Apr. 23, 2020

(30) Foreign Application Priority Data

Oct. 17, 2018 (KR) ..... 10-2018-0123767

(51) Int. Cl.

| | |
|---|---|
| ***D06F 33/48*** | (2020.01) |
| ***D06F 37/20*** | (2006.01) |
| ***D06F 33/00*** | (2020.01) |
| ***D06F 37/22*** | (2006.01) |
| ***D06F 37/30*** | (2020.01) |

(52) U.S. Cl.

CPC ..... *D06F 37/203* (2013.01); *D06F 33/00* (2013.01); *D06F 37/22* (2013.01); *D06F 37/30* (2013.01); *D06F 2222/00* (2013.01)

(58) Field of Classification Search

CPC ..... D06F 33/48

See application file for complete search history.

(56) References Cited

U.S. PATENT DOCUMENTS

2012/0192362 A1* 8/2012 Lee ..... D06F 33/00 8/137
2015/0368842 A1 12/2015 Kim et al.
2018/0223465 A1* 8/2018 Chae ..... D06F 33/00

FOREIGN PATENT DOCUMENTS

| | | |
|---|---|---|
| EP | 3378982 | 9/2018 |
| KR | 1020130114482 | 10/2013 |
| KR | 1020150140962 | 12/2015 |

OTHER PUBLICATIONS

Extended European Search Report in European Application No. 19203818.0. dated Apr. 7, 2020. 6 pages.

* cited by examiner

*Primary Examiner* — Jason Y Ko
(74) *Attorney, Agent, or Firm* — Fish & Richardson P.C.

(57) ABSTRACT

The present invention relates to a balancer and a washing machine including the same. The balancer includes at least two drive modules which provide a driving force; at least two gear rails having a ring shape which are gear-coupled to each of the drive modules and rotated; at least two balancing weights which move along a circumference of a drum by the rotation of each of the gear rails and change a center of gravity of the drum; a reception coil which generates power from a magnetic field formed by a transmission coil; and a guide case which accommodates at least the reception coil and the drive modules.

20 Claims, 8 Drawing Sheets

BALANCER AND WASHING MACHINE

CROSS-REFERENCE TO RELATED APPLICATION

This application claims the benefit of priority to Korean Application No. 10-2018-0123767, filed on Oct. 17, 2018. The disclosure of the prior application is incorporated by reference in its entirety.

BACKGROUND OF THE INVENTION

1. Field of the Invention

The present invention relates to a balancer that is actively movable and a washing machine equipped with a balancer.

2. Description of the Related Art

In general, a washing machine is an apparatus that performs cleaning through a process such as washing, rinsing, dehydrating, and the like to remove contamination on clothes, bedding, etc. (hereinafter, referred to as 'cloth') by using water, detergent, and mechanical action.

Washing machines are classified into agitator type, pulsator type, and drum type washing machines.

The agitator type washing machine performs washing by rotating a laundry rod towering in the center of the washing tub from side to side, the pulsator type washing machine rotates a disk-shaped rotary blades formed in the lower portion of the washing tub from side to side to perform washing by using frictional force between the water flow and the cloth, and the drum type washing machine performs washing by putting water, detergent, and cloth into the drum, and rotating the drum.

The drum washing machine is provided with a tub, a drum, a motor, and a drive shaft. The tub, in which washing water is accommodated, is provided inside a cabinet forming an outer shape. The drum, which accommodates a cloth, is disposed inside the tub. The motor is mounted in the rear surface side of the tub so as to rotate the drum. The drive shaft which penetrates through the motor and is connected to the rear surface side of is built up in the drum. The inside of the drum is equipped with a lifter to lift the cloth when the drum rotates.

Such a washing machine has a phenomenon in which the cloth is biased to one side due to the entanglement of the cloth, which causes an eccentricity in which one side becomes heavy based on the center of the drum. When the cloth is eccentric and the drum rotates at high speed (e.g., when the cloth is dehydrated), vibration and noise are generated by unbalance where the geometric center of the drum's rotation axis itself and the actual center of gravity are not coincident. An apparatus, which is called a balancer, for reducing the unbalance of the drum is installed in order to reduce such vibration and noise.

A counter weight for counterbalancing eccentricity by attaching additional mass has been used as a balancer for drum type washing machines. Recently, as shown in Korean Utility Model Publication No. 1998-019360, a ball balancer that has a ring-shaped space, which is formed in the front surface or rear surface of the drum, having a certain width in the circumferential direction, inserts a ball therein, and then, fills liquid to completely seal by heat-welding is mainly employed. When the drum rotates at high speed, the balancer distributes the inner material to move away from the center of gravity of the cloth so that the center of gravity of the drum approaches the center of rotation.

SUMMARY OF THE INVENTION

The present invention has been made in view of the above problems, and provides a balancer and a washing machine which actively move to actively eliminate an unbalance.

The present invention further provides a balancer and a washing machine which can operate by wireless power, have a simple structure, and can reduce the number of parts.

The present invention further provides a balancer and a washing machine which do not exert an influence on the center of gravity of the drum while disposing a reception coil and a drive module in a guide case.

In order to achieve the above object, the present invention includes: a tub which accommodates washing water, and has a transmission coil generating a wireless power signal and transmitting power wirelessly; a drum having a cylindrical shape which is disposed inside the tub, accommodates a cloth, and is rotatable; and a balancer which reduces unbalance generated by a bias of the cloth when the drum is rotated, wherein the balancer includes: at least two drive modules which provide a driving force; at least two gear rails having a ring shape which are gear-coupled to each of the drive modules and rotated; at least two balancing weights which move along a circumference of the drum by the rotation of each of the gear rails and change a center of gravity of the drum; a reception coil which generates power from a magnetic field formed by the transmission coil; and a guide case which accommodates at least the reception coil and the drive modules.

The drive modules includes a first drive module and a second drive module, wherein the reception coil and the first and second drive modules are spaced apart from each other on an arbitrary circumference around a rotation axis of the drum, and a separation distance between the reception coil and the first drive module is the same as a separation distance between the reception coil and the second drive module.

The drive modules include a first drive module and a second drive module, wherein the reception coil and the first and second drive modules are spaced apart from each other on an arbitrary circumference around a rotation axis of the drum, and a center angle between the reception coil and the first drive module is the same as a center angle between the reception coil and the second drive module.

The balancer further includes a circuit board which transmits power of the reception coil to the drive modules and generate a control signal for controlling the drive module, wherein the circuit board is accommodated in the guide case.

At least a part of the circuit board and the reception coil is disposed to overlap in a direction of rotation axis of the drum.

The guide case includes a guide part for defining a path through which the balancing weight is moved.

The guide part has a ring shape.

The guide case includes a drive module accommodating part which is extended from the guide part in a direction of rotation axis of the drum and accommodates each of the drive modules.

The guide case further includes a receiver accommodating part which is extended from the guide part in a direction of rotational axis of the drum to place the reception coil.

The balancer further includes a circuit board which transmits power of the reception coil to the drive modules, and generates a control signal for controlling the drive modules, wherein the circuit board is accommodated in the receiver accommodating part.

The drive module includes: a drive motor; and a pinion gear which is engaged with the drive motor and each of the gear rails.

The gear rail includes: a rail body having a ring shape; a rack gear formed in an inner circumferential surface of the rail body; and a protrusion which is protruded from an outer circumferential surface of the rail body and restrains the balancing weight.

The two gear rails are positioned at different heights.

The balancing weight includes: a balancing body which has a coupling groove coupled to the gear rail; and a roller coupled to the balancing body.

Each of the drive modules is positioned inside a circumference formed by the gear rail, and each of the balancing weights is positioned outside the circumference formed by the gear rail.

In accordance with another aspect of the present invention, a balancer includes: at least two drive modules which provide a driving force; at least two gear rails having a ring shape which are gear-coupled to each of the drive modules and rotated; at least two balancing weights which move along a circumference of a drum by the rotation of each of the gear rails and change a center of gravity of the drum; a reception coil which generates power from a magnetic field formed by a transmission coil; and a guide case which accommodates at least the reception coil and the drive modules.

BRIEF DESCRIPTION OF THE DRAWINGS

The above and other objects, features and advantages of the present invention will be more apparent from the following detailed description in conjunction with the accompanying drawings, in which.

DETAILED DESCRIPTION OF THE PREFERRED EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention. As used herein, the singular form is intended to include the plural forms as well, unless the context clearly indicates otherwise. In the present application, it will be further understood that the terms "comprises", includes," etc. specify the presence of stated features, integers, steps, operations, elements, components, or combinations thereof, but do not preclude the presence or addition of one or more other features, integers, steps, operations, elements, components, or combinations thereof. Unless defined otherwise, the terms including technical and scientific terms used in this specification may have the meaning that can be commonly apprehended by those skilled in the art. The terms, such as the terms defined in the commonly-used dictionary, must be interpreted based on the context of the related technology and must not be interpreted ideally or excessively.

Hereinafter, preferred embodiments of the present invention will be described with reference to the accompanying drawings.

Figure 1A:
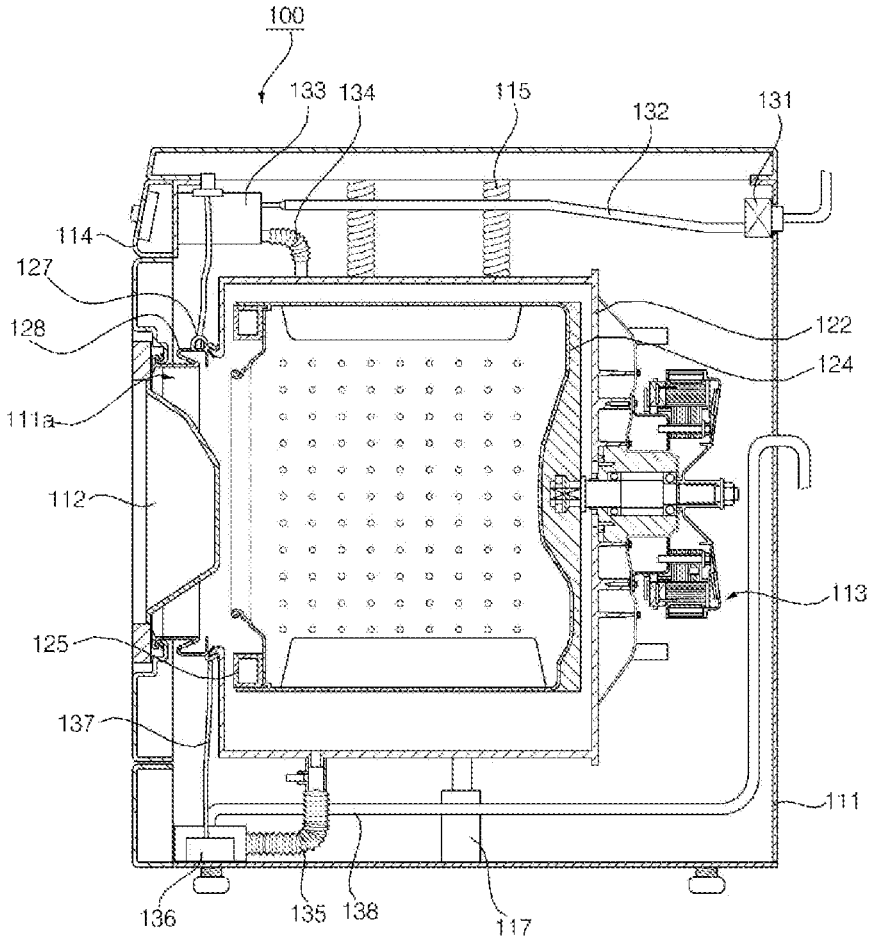
FIG. 1A is a cross-sectional view of a washing machine according to an embodiment of the present invention.
Figure 1B:
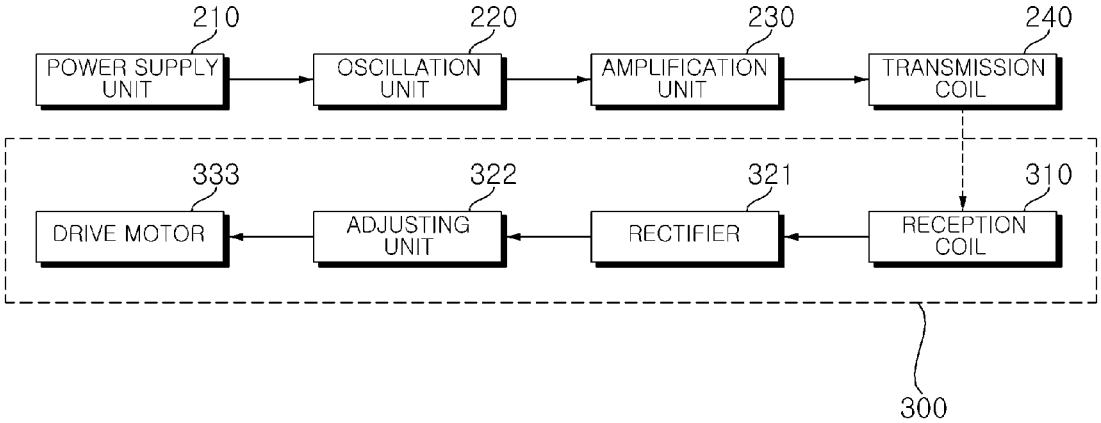
FIG. 1B is a block diagram of the washing machine shown in FIG. 1A.
Figure 2:
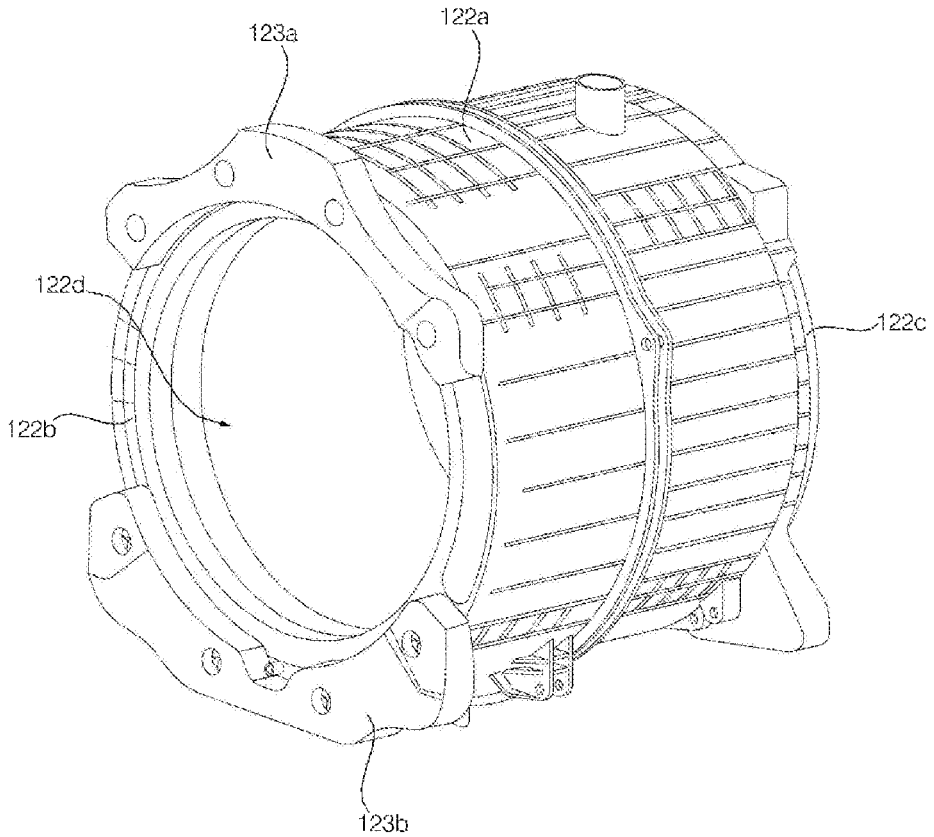
FIG. 2 is a perspective view of a tub of the washing machine shown in FIGS. 1A and 1B.
Figure 3:
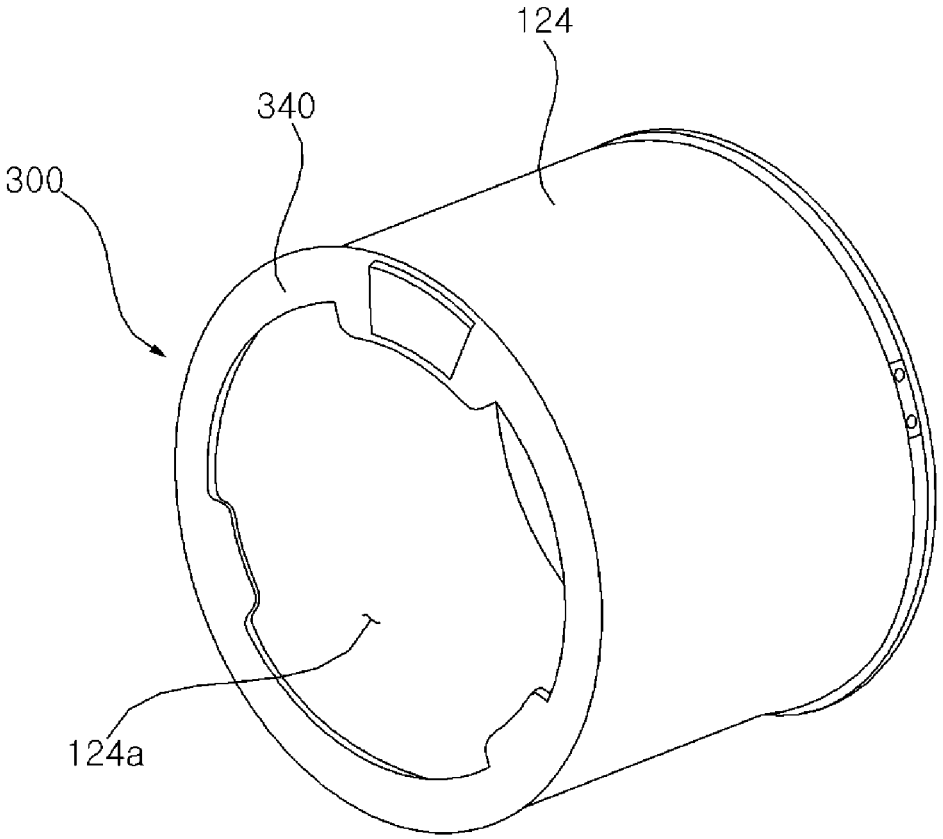
FIG. 3 is a perspective view of a drum of the washing machine shown in FIGS. 1A and 1B and a balancer installed in the drum.

FIG. 1A is a cross-sectional view of a washing machine according to an embodiment of the present invention, FIG. 1B is a block diagram of the washing machine shown in FIG. 1A, FIG. 2 is a perspective view of a tub of the washing machine shown in FIGS. 1A and 1B, and FIG. 3 is a perspective view of a drum of the washing machine shown in FIGS. 1A and 1B and a balancer installed in the drum.

A washing machine 100 according to an embodiment of the present invention includes a cabinet 111 which forms an outer shape, a door 112 which opens and closes one side of the cabinet to allow the cloth to enter and exit the cabinet, a tub 122 disposed inside the cabinet and supported by the cabinet, a drum 124 disposed inside the tub and rotating with a cloth inserted therein, a drum motor 113 which rotates the drum by applying torque to the drum, a detergent box 133 which accommodates detergent, and a control panel 114 which receives a user input and displays a washing machine state.

The cabinet 111 has a cloth loading hole 111*a* formed to allow the cloth to enter and exit. The door 112 is rotatably coupled to the cabinet 111 to allow the cloth loading hole 111*a* to be opened and closed. The cabinet 111 is provided with the control panel 114. The cabinet 111 is provided with a detergent box 133 to be withdrawn.

The tub 122 is disposed in the cabinet 111 to be buffered by a spring 115 and a damper 117. The tub 122 accommodates washing water. The tub 122 is disposed in the outside of the drum 124 while surrounding the drum 124.

The tub 122 includes a cylindrical tub body 122*a* having both sides opened, a ring-shaped front tub cover 122*b* disposed in an opened front side of the tub body 122*a*, and a disk-shaped rear tub cover 122*c* disposed in an opened rear side of the tub body 122*a*. Hereinafter, the front side means the door 112 side, and the rear side means the drum motor 113 side.

A tub hole 122*d* is formed in one side of the tub 122. The tub hole 122*d* is formed to communicate with the cloth loading hole 111*a* to allow the cloth to enter and exit the drum 124. The tub hole 122*d* is formed in the front tub cover 122*b*.

A weight 123 is coupled to a portion of one side edge of the tub 122. The weight 123 applies a load to the tub 122. The weight 123 is preferably disposed around the tub hole 122*d*. A plurality of weights 123 may be provided, and disposed in a portion of upper side and lower side of the front tub cover 122*b*.

The plurality of weights 123 includes an upper weight 123*a* disposed above the front tub cover 122*b* and a lower weight 123*b* disposed below the front tub cover 122*b*. The upper weight 123*a* is disposed above the tub hole 122*d* among the edge of the tub 122, and the lower weight 123*b* is disposed below the tub hole 122*d* among the edge of the tub 122.

A transmission coil 240 described later may be disposed in the edge of one side of the tub 122. The transmission coil 240 wirelessly supplies power to the balancer 300.

The drum motor 113 generates a rotational force. The drum motor 113 may rotate the drum 124 at various speeds or directions. The drum motor 113 includes a stator (not shown) wound around with a coil, and a rotor (not shown) that rotates by generating electromagnetic interaction with the coil.

The drum 124 accommodates the cloth and is rotated. The drum 124 is disposed inside the tub 122. The drum 124 is formed in a rotatable cylindrical shape. The drum 124 is provided with a plurality of through holes so that the washing water can pass. The drum 124 rotates while receiving the rotational force of the drum motor 113.

A drum hole 124*a* is formed in the front side of the drum 124. The drum hole 124*a* is formed to communicate with the cloth loading hole 111*a* and the tub hole 122*d* so that the cloth can be loaded into the drum 124.

The balancer is coupled to the edge of one side of the drum 124. The balancer reduces the unbalance generated by the biasing of the cloth when the drum rotates.

A gasket 128 seals between the tub 122 and the cabinet 111. The gasket 128 is disposed between the opening of the tub 122 and the cloth loading hole 111*a*. The gasket 128 mitigates the shock transmitted to the door 112 when the drum 124 rotates, while preventing the washing water in the tub 122 from leaking to the outside. The gasket 128 may be provided with a circulation nozzle 127 for introducing washing water into the drum 124.

The detergent box 133 accommodates a detergent such as laundry detergent, fabric softener or bleach. The detergent box 133 is preferably provided in the front surface of the cabinet 111 to be withdrawn. The detergent in the detergent box 133 is mixed with the washing water when the washing water is supplied, and introduced into the tub 122.

It is preferable that a water supply valve 131 for controlling the inflow of the washing water from an external water source, a water supply flow path 132 through which the washing water introduced into the water supply valve flows into the detergent box 133, and a water supply pipe 134 for introducing washing water mixed with detergent in the detergent box 133 into the tub 122 are provided inside the cabinet 111.

It is preferable that a drain pipe 135 through which the washing water in the tub 122 is discharged, a pump 136 for discharging the washing water in the tub, a circulation flow path 137 for circulating the washing water, a circulation nozzle 127 for introducing the washing water into the drum 124, and a drain flow path 138 for draining the washing water to the outside are provided inside the cabinet 111. According to an embodiment, the pump 136 may be provided with a circulation pump and a drain pump, and may be connected to the circulation flow path 137 and the drain flow path 138, respectively.

The balancer 300 is provided in the front side and/or rear side of the drum 124 and, in the present embodiment, is coupled to the edge of the front side of the drum 124. The balancer 300 is preferably disposed around the drum hole 124*a*.

The balancer 300 moves along the edge of the drum 124 and changes the center of gravity of the drum 124. In this case, the center of gravity of the drum 124 does not mean the center of gravity of the drum 124 itself, but means a common center of gravity of objects including the drum 124, the cloth accommodated in the drum 124, the balancer 300, and components attached to the drum 124 that rotate together with the drum 124 when the drum 124 rotates.

The balancer 300 moves along the circumferential direction of the drum 124 to adjust the center of gravity of the drum 124 when the cloth is eccentric. When the drum 124 rotates while the cloth is eccentric, vibration and noise are generated due to unbalance in which the geometric center of a rotation axis Ax itself and the actual center of gravity of the drum 124 are not coincident. The balancer 300 reduces the unbalance of the drum 124 by allowing the center of gravity of the drum 124 to approach the rotation axis Ax.

The control panel 114 may include an input unit (not shown) for receiving various operation commands such as a washing course selection, an operation time and reservation for each process through a user, and a display unit (not shown) for displaying the operation state of the washing machine 100.

Referring to FIG. 1B, the washing machine according to an embodiment of the present invention includes a power supply unit 210 for supplying electric power from the outside, an oscillation unit 220 for generating a voltage fluctuation range in the power supplied from the power supply unit 210, an amplification unit 230 for amplifying the power, a transmission coil 240 for generating a magnetic field, a reception coil 310 for generating power due to electromagnetic induction from a magnetic field, a rectifier 321 for converting a power generated in the reception coil 310 into a direct power, an adjusting unit 322 for adjusting the power into a certain voltage and current, and a drive motor 330 for generating power.

The power supply unit 210 converts commercial power, which is AC supplied from the outside, into an appropriate power. In the present embodiment, the power supply unit is a switched-mode power supply to convert the commercial power into 14V DC. The power supply unit 210 may be provided in a certain position inside the cabinet 111 or in the control panel 114. The power converted and supplied by the power supply unit 210 may also be supplied to the drum motor 113.

The oscillation unit 220 is an oscillator, and generates a voltage fluctuation range in the power supplied from the power supply unit 210 to generate a magnetic field in the transmission coil 240. The amplifier 230 amplifies the power so that the transmission coil 240 can acquire a sufficient current.

The transmission coil 240 generates a magnetic field, and the reception coil 310 generates power due to electromagnetic induction from the magnetic field which the transmission coil 240 generated.

The rectifier 321 converts the power generated from the reception coil 310 into DC power. The adjusting unit 322 adjusts the power rectified by the rectifier 321 into a certain voltage and current.

The drive motor 330 generates power from the power adjusted by the adjusting unit 322. The drive motor 330 generate power from the power that is supplied from the outside and transmitted wirelessly through the transmission coil 240 and the reception coil 310. Generally, the adjusting unit 322 and the rectifier 321 are disposed in a circuit board 370 described later.

According to an embodiment, a storage unit (not shown) for temporarily storing the power adjusted by the adjusting unit 322 may be provided, and the storage unit (not shown) may be configured of a capacitor or a battery.

The above-mentioned oscillation unit 220 and amplifier 230 are preferably provided in a certain position inside the cabinet 111 or in the control panel 114, and the reception coil 310, the rectifier 321, the adjusting unit 322, and the drive motor 330 are preferably included in the balancer 300.

The transmission coil 240 is disposed in the edge of one side of the tub 122 as described above.

The transmission coil 240 is disposed in the tub 122 to correspond to the movement path of the balancer 300 and wirelessly supplies power to the balancer 300. The transmission coil 240 may be disposed in the tub 122 in correspondence with a guide case 340 described later.

The transmission coil 240 may be formed in an arc shape and disposed in a portion of one side edge of the tub 122, or may be formed in a ring shape and disposed in the entire of one side edge of the tub 122. The transmission coil 240 is preferably disposed around the tub hole 122*d* which is an edge of the front side of the tub 122.

The transmission coil 240 may be disposed in the front tub cover 122*b* or the rear tub cover 122*c*. In the present embodiment, the transmission coil 240 is disposed in the front tub cover 122*b*. The transmission coil 240 is preferably disposed in the front side of the front tub cover 122*b* to face a guide rail 125.

The tub 122 is preferably coupled to a coil cover (not shown) surrounding the transmission coil 240. The coil cover (not shown) is coupled to the front tub cover 122*b* to surround the transmission coil 240. The coil cover (not shown) protects the transmission coil 240 from water or foreign matter together with the front tub cover 122*b*.

The transmission coil 240 is preferably disposed in the front tub cover 122*b* in correspondence with the balancer 300. The reception coil 310 is provided in one side of the balancer 300 and the transmission coil 240 is disposed to correspond to the reception coil 310. The transmission coil 240 is disposed in a portion of the moving path of the reception coil 310 to allow the magnetic field generated in the transmission coil 240 to be converted into power in the reception coil 310.

It is preferable that the distance between the transmission coil 240 and the reception coil 310 maintains a distance in which power can be transmitted wirelessly. The distance between the transmission coil 240 and the reception coil 310 is preferably within 30 mm.

When a plurality of balancers 300 are provided, a plurality of transmission coils 240 may be provided.

Referring to FIG. 2, the weight 123 is coupled to a portion of the edge of the drum 124. The transmission coil 240 is preferably disposed in an area where the weight 123 is not disposed among the edge of one side of the tub 122. At this time, the transmission coil 240 is preferably formed in an arc shape.

A plurality of weights 123 are provided and disposed in a portion of the upper and lower sides of the front tub cover 122*b*. A plurality of transmission coils 240 are provided in both sides of the front tub cover 122*b* between the upper weight 123*a* and the lower weight 123*b*.

Figure 4:
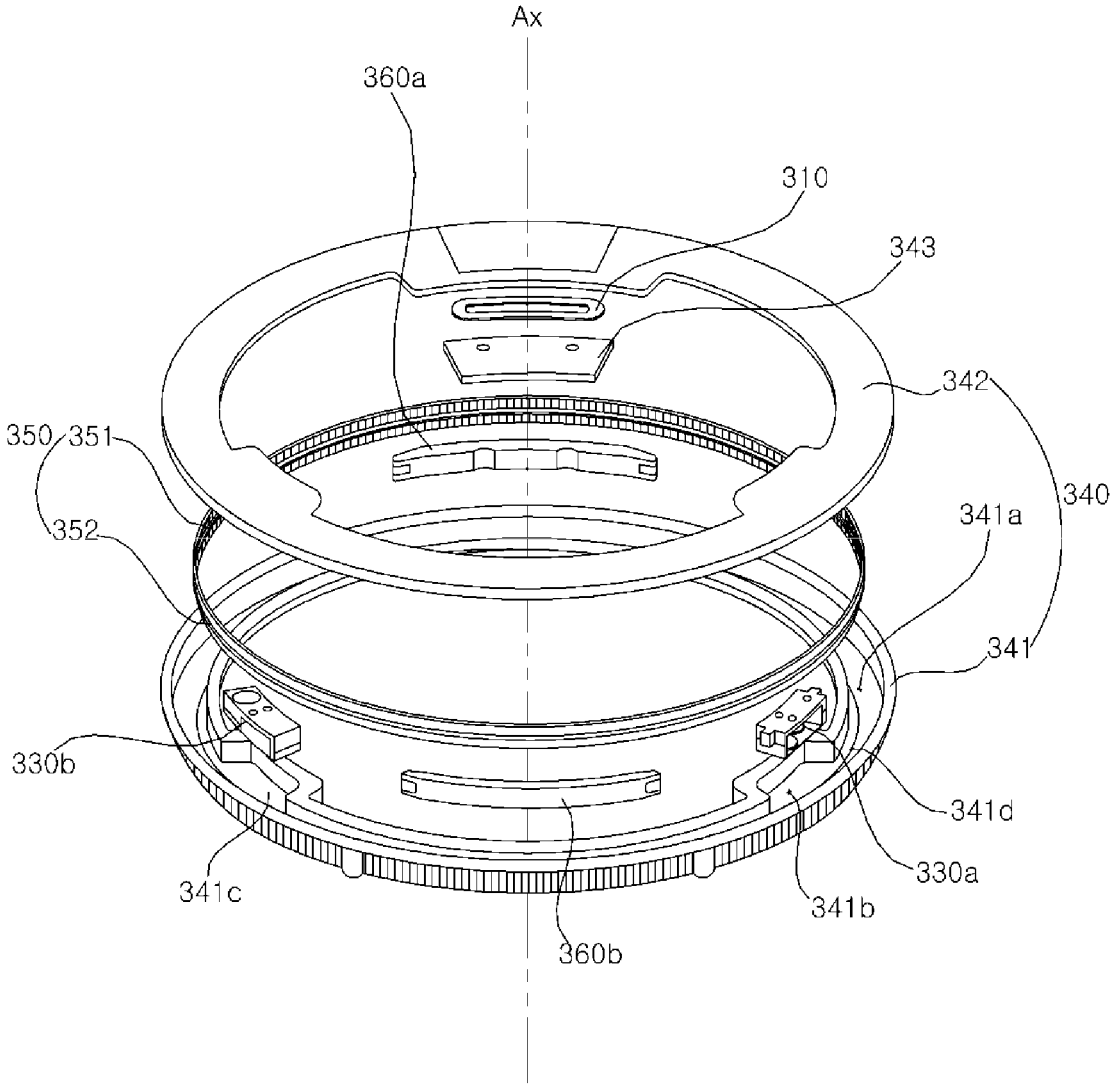
FIG. 4 is an exploded perspective view of a balancer according to an embodiment of the present invention.
Figure 5:
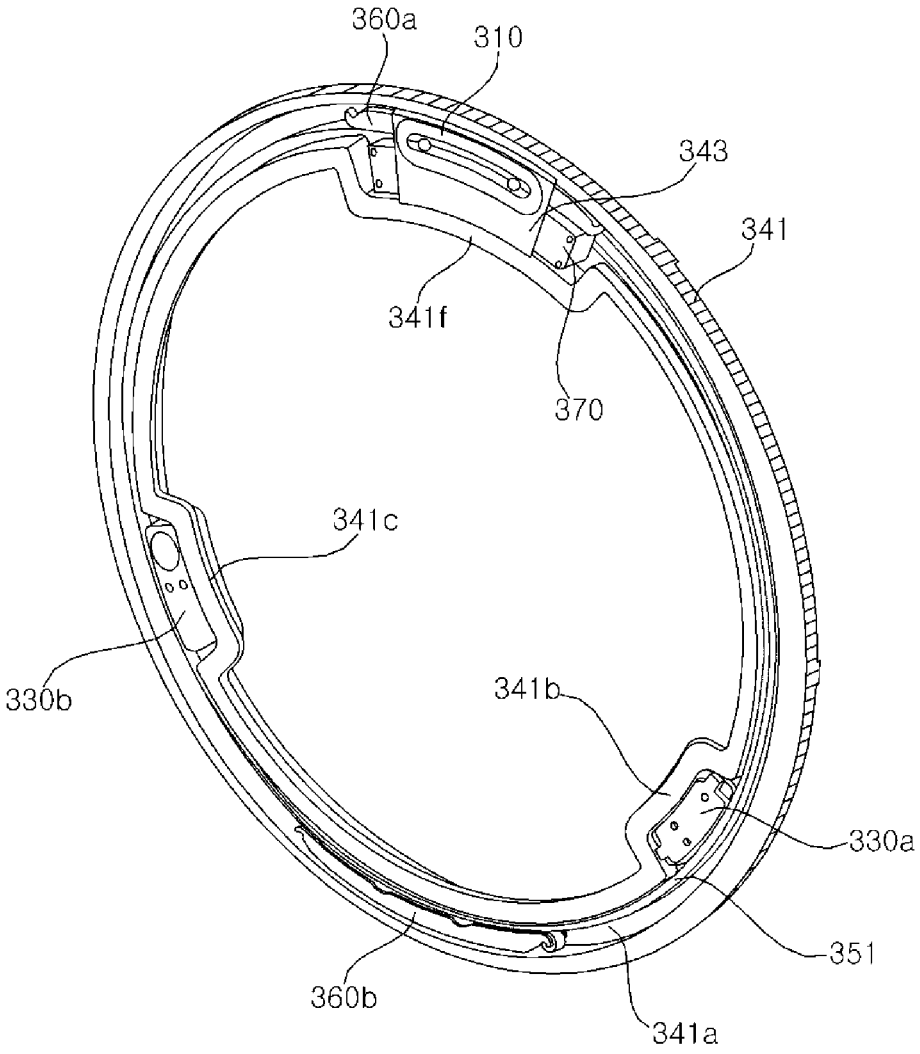
FIG. 5 is a perspective view of a balancer according to an embodiment of the present invention.
Figure 6:
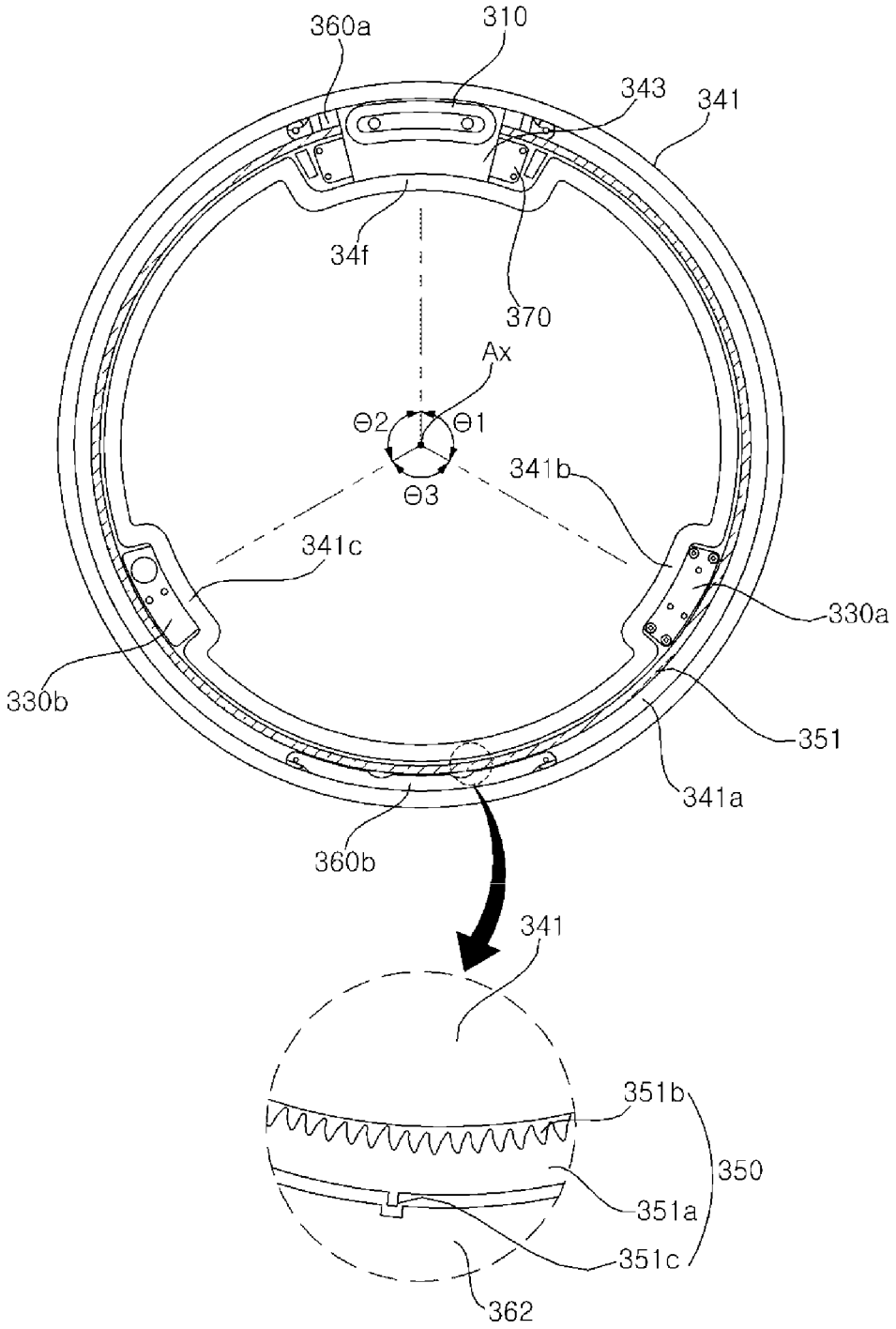
FIG. 6 is a plan view of a balancer according to an embodiment of the present invention.
Figure 7:
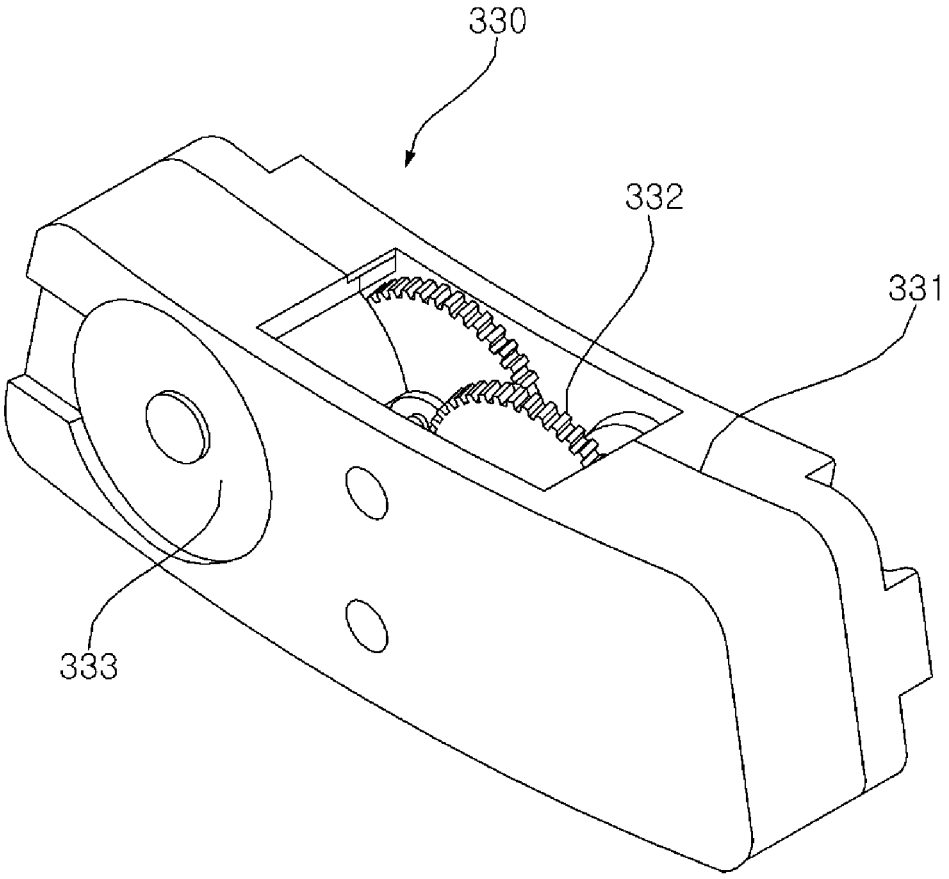
FIG. 7 is a perspective view of a drive module according to an embodiment of the present invention.
Figure 8:
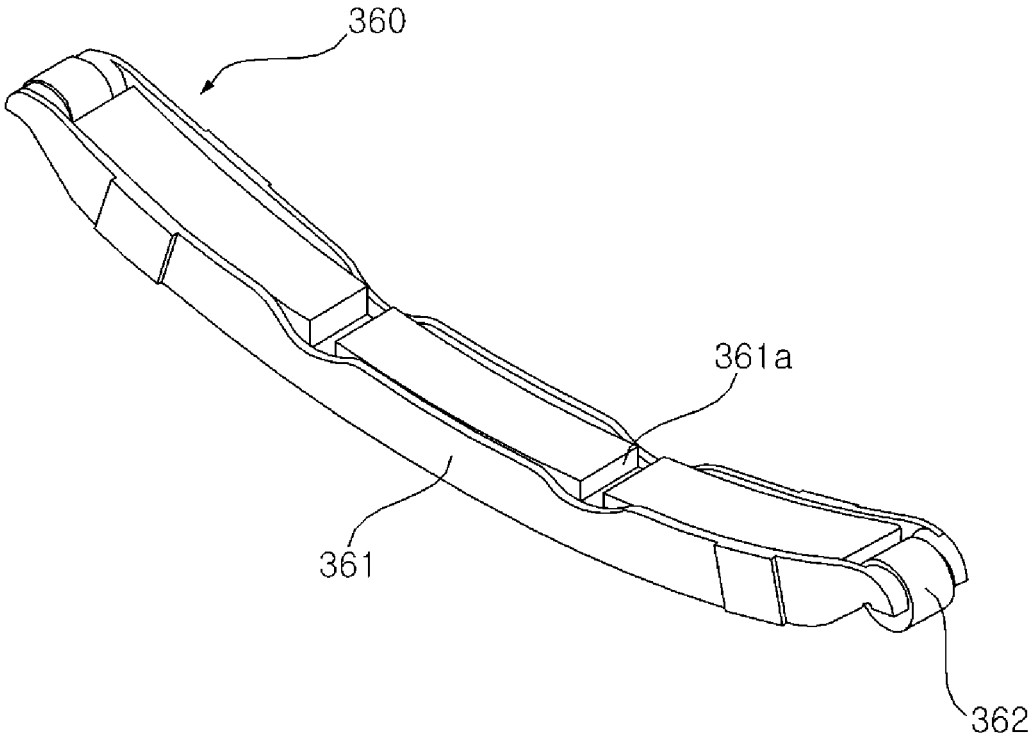
FIG. 8 is a perspective view of a balancing weight according to an embodiment of the present invention.

FIG. 4 is an exploded perspective view of a balancer 300 according to an embodiment of the present invention, FIG. is a perspective view of a balancer 300 according to an embodiment of the present invention, FIG. 6 is a plan view of a balancer 300 according to an embodiment of the present invention, FIG. 7 is a perspective view of a drive module 300 according to an embodiment of the present invention, and FIG. 8 is a perspective view of a balancing weight 300 according to an embodiment of the present invention.

Hereinafter, referring to FIGS. 4 to 8, the balancer 300 will be described in detail.

The balancer 300 may further include at least two drive modules 330 which provide driving force, at least two gear rails 350 which have a ring shape and are rotated while being gear-coupled with each drive module 330, at least two balancing weights 360 which move along the circumference of the drum 124 due to rotation of each gear rail 350 and change the center of gravity of the drum 124, a reception coil 310 which generates power from a magnetic field formed by the transmission coil, and a guide case 340 for accommodating at least the reception coil 310 and the drive modules 330.

The guide case 340 accommodates at least reception coil 310 and drive module 330. Preferably, the guide case 340 may accommodate a circuit board 370 described later, a balancing weight 360, and a gear rail 350. The guide case 340 may be provided in the front side and/or rear side of the drum 124, and in the present embodiment, the guide case 340 is provided in the front side of the drum 124. When the drum 124 is rotated, the cloth accommodated in the drum 124 is generally collected in the inner side of the drum 124, i.e., in the rear side. Accordingly, it is preferable that the guide case 340 is provided in the front side of the drum 124 so as to be balanced with the cloth collected in the rear side of the drum 124.

According to the present invention, the drive module 330 and the circuit board 370 are not integrally formed with the balancing weight 360, but separately fixed to the guide case 340, so that the drive module 330 and the circuit board 370 do not move when the balancing weight 360 is moved, thereby reducing damage occurred during movement.

The guide case 340 has a ring shape corresponding to the circumference of the drum 124, and may have a space in which the balancing weight 360 moves along the circumference of the drum 124, a space for accommodating the drive module 330 and the reception coil 310, and a space for accommodating the gear rail 350.

In detail, the guide case 340 may include a case body 341 and a case cover 342 covering the case body 341.

The case body 341 is provided with a guide part 341*a* which is a path through which the balancing weight 360 passes. The guide part 341*a* is formed in such a manner that a cross section of the case body 341 is recessed downward so that the balancing weight 360 is movable therein. The guide part 341*a* may have a ring shape corresponding to the circumference of the drum 124 so as to guide a path along which the balancing weight 360 moves.

The guide case 340 may further include a drive module accommodating part 341*b* and 341*c* extended from the guide part 341*a* in the direction of the rotation axis Ax of the drum 124 to accommodate each drive module 330. The drive module accommodating part 341*b* and 341*c* may be formed in such a manner that a portion of the case body 341 is recessed in the downward direction. In detail, the drive module accommodating part 341*b* and 341*c* may be defined as a recessed area communicating with the guide part 341*a*.

The guide case 340 may further include a receiver accommodating part 341*f* extended from the guide part 341*a* in the direction of the rotation axis Ax of the drum 124 to place the reception coil 310. The receiver accommodating part 341*f* may be formed in such a manner that a portion of the case body 341 is recessed in the downward direction. In detail, the receiver accommodating part 341*f* may be defined as a recessed area communicating with the guide part 341*a*.

Obviously, the reception coil 310 may be accommodated directly in the receiver accommodating part 341*f*, or a base board may be installed in the receiver accommodating part 341*f*, and the reception coil 310 may be installed in the base board.

The guide case 340 may further include a rail accommodating part 341*d* that is extended from the guide part 341*a* in the direction of the rotation axis Ax of the drum 124 so that the reception coil 310 can be positioned. The rail accommodating part 341*d* may be formed in such a manner that a portion of the case body 341 is recessed in the downward direction. Specifically, the rail accommodating part 341*d* may be defined as a recessed area communicating with the guide part 341*a*.

The rail accommodating part 341*d* may be positioned inside the guide part 341*a*, and the drive module accommodating parts 341*b* and 341*c* and the receiver accommodating part 341*f* may be positioned to be spaced apart from each other inside the rail accommodating part 341*d*.

The balancer 300 may further include the circuit board 370 which transmits the power of the reception coil 310 to the drive modules 330 and generates a control signal for controlling the drive module 330.

According to the present invention, the manufacturing cost can be reduced by controlling the two drive modules 330 based on a single circuit board 370, and the circuit board 370 does not move together with the balancing weight 360, thereby improving reliability. The circuit board 370 is accommodated in the guide case 340. Specifically, it is accommodated in the receiver accommodating part 341*f* of the guide case 340.

It is preferable that at least a portion of the circuit board 370 and the reception coil 310 is disposed to overlap with each other in the rotation axis Ax direction of the drum 124. This is because the power generated by the reception coil 310 is transmitted to the circuit board 370 in the shortest distance, thereby reducing the manufacturing cost.

The drive module 330 provides a driving force. The number of drive modules 330 corresponds to the number of balancing weights 360. In detail, the drive module 330 may include a first drive module 330*a* and a second drive module 330*b*.

Each drive module 330 may include a drive motor 333, a pinion gear 332 engaged with the drive motor 333 and each gear rail 350, and a motor housing 331 for accommodating the drive motor 333 and the pinion gear 332.

The drive motor 333 generates a driving force from the power which is supplied from the outside and transmitted wirelessly through the transmission coil 240 and the reception coil 310. The drive motor 333 is preferably a motor that generates a rotational force. When the drive motor 333 is a motor, a worm gear is disposed between the motor and the pinion gear 332 and the rotational force of the motor changes the axis of the motor to rotate the pinion gear 332.

The pinion gear 332 is rotated by receiving power from the drive motor 333. A rack gear 351*b* is disposed in the inner circumferential surface of the gear rail 350, and the pinion gear 332 meshes with the rack gear 351*b* and 125*a*.

The pinion gear 332 rotates while engaging with the rack gear 351*b* and 125*a* to rotate the gear rail 350, and when the gear rail 350 rotates, the balancing weight 360 restrained to the gear rail 350 is moved.

The pinion gear 332 is engaged with the rack gears 351*b* and 125*a* to prevent the balancing weight 360 from moving by its own weight or by centrifugal force when the drum 124 rotates.

The motor housing 331 accommodates the pinion gear and the drive motor 333 and is fixed to the guide case 340. The motor housing 331 is fixed to the drive module accommodating part 341*b* and 341*c*.

When the reception coil 310 and the first and second drive modules 330 are disposed to be biased toward one side of the guide case 340, it may cause unbalance of the drum 124. Accordingly, it is preferable that the reception coil 310 and the first and second drive modules 330 are disposed in consideration of the balance of the center of gravity of the drum 124.

For example, the reception coil 310 and the first and second drive module 330 are spaced apart from each other on an arbitrary circumference around the axis of rotation Ax of the drum 124, and the separation distance between the reception coil 310 and the first drive module 330*a* may be the same as the separation distance between the reception coil 310 and the second drive module 330*b*. This is because the weight of the first drive module 330*a* and the second drive module 330*b* and the weight of the reception coil 310 are different.

Preferably, the reception coil 310 and the first and second drive modules 330 are spaced apart from each other on an arbitrary circumference around the axis of rotation Ax of the drum 124, and the reception coil 310. The separation distance between the reception coil 310 and the first drive module 330*a* may be the same as the separation distance between the reception coil 310 and the second drive module 330*b*, and the separation distance between the first drive module 330*a* and the second drive module 330*b* may be the same as the separation distance between the reception coil 310 and the first drive module 330*a*. At this time, the weight of the first drive module 330*a* and the second drive module 330*b* and the weight of the reception coil 310 may be the same.

For another example, the center angle between the reception coil 310 and the first drive module 330*a* may be the same as the center angle between the reception coil 310 and the second drive module 330*b*. This is because the weight of the first drive module 330*a* and the second drive module 330*b* and the weight of the reception coil 310 are different.

Specifically, the center angle between the reception coil 310 and the first drive module 330*a* may be the same as the center angle between the reception coil 310 and the second drive module 330*b*, and the center angle between the first drive module 330*a* and the second drive module 330*b* may be the same as the center angle between the reception coil 310 and the first drive module 330*a*. At this time, the weight of the first drive module 330*a* and the second drive module 330*b* and the weight of the reception coil 310 may be the same.

Here, the center angle between the reception coil 310 and the first drive module 330*a* may be referred to as a first center angle θ1, the center angle between the reception coil 310 and the second drive module 330*b* may be referred to as a second center angle θ2, and the center angle between the first drive module 330*a* and the second drive module 330*b* may be referred to as a third center angle θ3.

As shown in FIG. 6, the first center angle means an angle between a line connecting the center of the reception coil 310 and the rotation axis Ax of the drum 124, and a line connecting the center of the first drive module 330*a* and the rotation axis Ax of the drum 124, the second center angle means an angle between a line connecting the center of the reception coil 310 and the rotation axis Ax of the drum 124, and a line connecting the center of the second drive module 330*b* and the rotation axis Ax of the drum 124, and the third center angle means an angle between a line connecting the center of the second drive module 330*b* and the rotation axis Ax of the drum 124, and a line connecting the center of the first drive module 330*a* and the rotation axis Ax of the drum 124.

Here, "the same" does not mean the exact same in the mathematical sense, but means that the approximation is the same within a range including an error. The first center angle, the second center angle, and the third center angle may be 119 degrees to 121 degrees.

The gear rail 350 is gear-coupled and rotated with each drive module 330. The gear rail 350 may have a ring shape having a diameter smaller than that of the guide part 341*a*.

For example, the gear rail 350 may include a ring-shaped rail body 351*a*, a rack gear 351*b* formed on the inner circumferential surface of the rail body 351*a*, and a protrusion 351*c* which is protruded from the outer circumferential surface of the rail body 351*a* and restrains the balancing weight 360.

The rack gear 351*b* is formed along the inner circumferential surface of the rail body 351*a*. The inner circumferential surface of the rail body 351*a* means a surface relatively close to the rotation axis Ax of the drum 124 in the rail body 351*a*, and the outer circumferential surface of the rail body 351*a* means a surface positioned farther from the rotation axis Ax of the drum 124 than the outer circumferential surface of the rail body 351*a* in the rail body 351*a*. The inner circumferential surface of the rail body 351*a* and the outer circumferential surface of the rail body 351*a* may be disposed to face each other. The inner circumferential surface of the rail body 351*a* and the outer circumferential surface of the rail body 351*a* are disposed to surround the rotation shaft Ax of the drum 124.

The gear rail 350 may be provided to correspond to the number of drive modules 330. The gear rail 350 includes a first gear rail 351 and a second gear rail 352. The first gear rail 351 is rotated by the driving force of the first drive module 330*a*, and the second gear rail 352 is rotated by the driving force of the second drive module 330*b*. The rack gear 351*b* of the first gear rail 351 is engaged with the pinion gear 332 of the first drive module 330*a*, and the rack gear 351*b* of the second gear rail 352 is engaged with the pinion gear 332 of the second drive module 330*b*.

The gear rail 350 may be accommodated in the rail accommodating part 341*d*. The gear rail 350 may rotate while sliding in the rail accommodating part 341*d*.

The two gear rails 350 may be positioned at different heights. The first gear rail 351 and the second gear rail 352 may be disposed to overlap in the direction of the central axis of the drum 124. In FIG. 4, the first gear rail 351 is disposed above the second gear rail 352.

The balancing weight 360 moves along the circumference of the drum 124 by the rotation of each gear rail 350 to change the center of gravity of the drum 124. At least two balancing weights 360 are provided, and each balancing weight 360 is restrained by each gear rail 350. The balancing weight 360 may include a first balancing weight 360 and a second balancing weight 360.

The balancing weight 360 may include a balancing body 361 having a coupling groove 361*a* coupled to the gear rail 350, and a roller 362 coupled to the balancing body 361.

The balancing body 361 may include an object having a weight or mass. The balancing body 361 has an arc shape, and a coupling groove 361*a* may be formed on a surface facing the outer circumferential surface of the gear rail 350. The protrusion 351*c* of the gear rail 350 is inserted into the coupling groove 361*a*. The protrusion 351*c* is inserted into the coupling groove 361*a* of the balancing body 361, so that the movement of the balancing body is constrained by the rotation of the gear rail 350.

The roller 362 is provided in the balancing body 361 so as to be rotatable. The roller 362 is in close contact with the inner surface of the guide part 341*a* and rolls. The roller 362 prevents the balancing body 361 from directly touching the inner surface of the guide part 341*a*. It is preferable that a plurality of rollers 362 are provided in both ends of the balancing body 361.

It is preferable that each drive module 330 is positioned inside an arbitrary circumference formed by the gear rail 350, and each balancing weight 360 is positioned outside of an arbitrary circumference formed by the gear rail 350, in terms of utilization of space.

According to the balancer and the washing machine of the present invention, there are one or more of the following effects.

First, even if the balancer rotates with the drum, a wireless power transmitter can wirelessly transmit sufficient power to the balancer in a short time.

Secondly, even if communication is not accomplished between the wireless power transmitter and the balancer that receives the power, no problem occurs in transmitting power wirelessly by controlling only the wireless power transmitter.

Third, since the balancing weight that moves actively, the drive module, and the reception coil are separated respectively, and the drive module and the balancing weight are not manufactured integrally, the manufacturing can be easily performed and the manufacturing cost can be reduced.

Fourth, since each drive module and the circuit board for controlling each drive module and supplying power are separated from each other and a single circuit board and a single reception coil are used, manufacturing cost is reduced, and the reliability is improved as the drive module does not move together with the balancing weight.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A washing machine comprising:

a tub configured to accommodate washing water;

a transmission coil that is attached to the tub and that is configured to generate a power signal to transmit power wirelessly;

a drum rotatably disposed inside the tub in a cylindrical shape and configured to accommodate laundry; and a balancer configured to reduce unbalance of the drum caused by the laundry becoming biased toward one side of the drum during a rotation of the drum, wherein the balancer comprises:

at least two drive modules configured to provide a driving force;

at least two gear rails that have a ring shape and that are configured to rotate while being coupled with each drive module;

at least two balancing weights configured to move along a circumference of the drum according to the rotation of the gear rails and change a center of gravity of the drum;

a reception coil configured to generate power from a magnetic field caused by the power signal of the transmission coil; and a guide case configured to accommodate at least the reception coil and the drive modules.

2. The washing machine of claim 1, wherein the drive modules comprise a first drive module and a second drive module, wherein the reception coil, the first drive module, and the second drive module are spaced apart from each other on a circumference around a rotation axis of the drum, and wherein a separation distance between the reception coil and the first drive module equals a separation distance between the reception coil and the second drive module.

3. The washing machine of claim 1, wherein the drive modules comprise a first drive module and a second drive module, wherein the reception coil, the first drive module, and the second drive module are spaced apart from each other on a circumference around a rotation axis of the drum, and wherein a center angle between the reception coil and the first drive module at a rotation axis of the drum equals a center angle between the reception coil and the second drive module at the rotation axis of the drum.

4. The washing machine of claim 1, wherein the balancer further comprises a circuit board configured to transmit power from the reception coil to the drive modules and generate a control signal for controlling the drive modules, and wherein the circuit board is accommodated in the guide case.

5. The washing machine of claim 4, wherein at least a portion of the circuit board and the reception coil are overlapped with each other in a direction of a rotation axis of the drum.

6. The washing machine of claim 1, wherein the guide case comprises a guide part configured to define a path along which the balancing weights move.

7. The washing machine of claim 6, wherein the guide part has a ring shape that corresponds to the circumference of the drum.

8. The washing machine of claim 6, wherein the guide case comprises a drive module accommodating part that extends from the guide part along a direction of a rotation axis of the drum and accommodates the drive modules.

9. The washing machine of claim 6, wherein the guide case further comprises a receiver accommodating part that extends from the guide part along a direction of a rotation axis of the drum to accommodate the reception coil.

10. The washing machine of claim 9, wherein the balancer further comprises a circuit board configured to transmit power from the reception coil to the drive modules, and generate a control signal for controlling the drive modules, and wherein the circuit board is accommodated in the receiver accommodating part.

11. The washing machine of claim 1, wherein the drive module comprises:

a drive motor configured to generate the driving force; and a pinion gear that is configured to receive the driving force from the drive motor and that is engaged with the drive motor and the gear rails.

12. The washing machine of claim 1, wherein each of the gear rails comprises:

a rail body that has a ring shape;

a rack gear located on an inner circumferential surface of the rail body; and a protrusion that protrudes toward an outer circumferential surface of the rail body and configured to restrain the balancing weights.

13. The washing machine of claim 1, wherein the at least two gear rails are located at different heights.

14. The washing machine of claim 1, wherein each of the balancing weights comprises:

a balancing body that has a coupling groove coupled to at least one of the gear rails; and a roller that couples to the balancing body.

15. The washing machine of claim 1, wherein the drive modules are located at an inside circumference of the gear rails, and wherein the balancing weights are located at an outside circumference of the gear rails.

16. A balancer comprising:

at least two drive modules configured to provide a driving force;

at least two gear rails that have a ring shape and that are configured to rotate while being coupled with each drive module;

at least two balancing weights configured to move along a circumference of a drum according to a rotation of the gear rails and change a gravity center of the drum;

a reception coil configured to generate power from a magnetic field caused by a power signal of a transmission coil; and a guide case configured to accommodate at least the reception coil and the drive modules.

17. The balancer of claim 16, wherein the drive modules comprise a first drive module and a second drive module, wherein the reception coil, the first drive module, and the second drive module are spaced apart from each other on a circumference around a rotation axis of the drum, wherein a separation distance between the reception coil and the first drive module equals a separation distance between the reception coil and the second drive module, and wherein a separation distance between the first drive module and the second drive module equals a separation distance between the reception coil and the first drive module.

18. The balancer of claim 16, wherein the drive modules comprise a first drive module and a second drive module, wherein the reception coil, the first drive module, and the second drive module are spaced apart from each other on a circumference around a rotation axis of the drum, and wherein a center angle between the reception coil and the first drive module at a rotation axis of the drum equals a center angle between the reception coil and the second drive module at the rotation axis of the drum, and a center angle between the first drive module and the second drive module at the rotation axis of the drum equals a center angle between the reception coil and the first drive module at the rotation axis of the drum.

19. The balancer of claim 16, wherein the balancer further comprises a circuit board configured to transmit power from the reception coil to the drive modules and generate a control signal for controlling the drive modules, and wherein the circuit board is accommodated in the guide case.

20. The balancer of claim 19, wherein at least a portion of the circuit board and the reception coil are overlapped with each other in a direction of a rotation axis of the drum.

* * * * *